US007882772B2

(12) United States Patent
Wise

(10) Patent No.: US 7,882,772 B2
(45) Date of Patent: Feb. 8, 2011

(54) REPETITIVE FENCE FOR CROSS-CUTTING MATERIALS

(76) Inventor: Robert W. Wise, 365 Ely Rd., Petaluma, CA (US) 94954

( * ) Notice: Subject to any disclaimer, the term of this patent is extended or adjusted under 35 U.S.C. 154(b) by 1022 days.

(21) Appl. No.: 11/013,129

(22) Filed: Dec. 15, 2004

(65) Prior Publication Data

US 2008/0282862 A1 Nov. 20, 2008

(51) Int. Cl.
*B26D 7/01* (2006.01)
*B26D 7/27* (2006.01)

(52) U.S. Cl. ..... 83/468.2; 83/522.17

(58) Field of Classification Search ..... 83/468.2, 83/522.17, 471, 477.2, 477.1, 478, 477, 581, 83/491, 468, 468.3, 468.5, 468.6, 468.7, 83/522.11

See application file for complete search history.

(56) References Cited

U.S. PATENT DOCUMENTS 3,680,214 A * 8/1972 Quenot ..... 33/501.03
4,551,847 A * 11/1985 Caldwell ..... 377/24
4,711,035 A * 12/1987 Logan et al. ..... 33/200
4,977,524 A * 12/1990 Strege et al. ..... 700/279
5,044,089 A * 9/1991 Petkovic et al. ..... 33/755
5,225,830 A 7/1993 Andermo et al.
5,386,643 A * 2/1995 Corcoran ..... 33/762
5,490,665 A 2/1996 Thiele et al.
5,691,923 A 11/1997 Adler et al.
RE36,257 E 7/1999 Thomson
5,983,514 A 11/1999 Lindsey
6,453,575 B1 * 9/2002 Hsieh ..... 33/761
2002/0134212 A1 9/2002 Ceroll et al.

FOREIGN PATENT DOCUMENTS

EP 0 743 120 A 11/1996

* cited by examiner

*Primary Examiner*—Ghassem Alie
(74) *Attorney, Agent, or Firm*—Black Lowe & Graham PLLC

(57) ABSTRACT

A repetitive fence utilizes a plurality of telescoping arms driven by a metal tape of the tape measure type to position a stop member at a desired location from a saw blade. A user can position a work piece, such as board lumber against the stop member to repeatedly position the work piece at a desired cut dimension with respect to a saw blade. The repetitive fence preferably employs a plurality of telescoping arms to position the stop member at the desired location, and an electronic read-out provided to indicate to the user the position of the stop member with respect to the saw blade. The telescoping arms can be motivated by electronic devices, such as an electric motor, or by a manual crank.

20 Claims, 7 Drawing Sheets

REPETITIVE FENCE FOR CROSS-CUTTING MATERIALS

TECHNICAL FIELD

The invention relates to repetitive fences for use with cross-cutting saws. More specifically, the invention relates to a repetitive fence for attachment to a cross-cut saw, such as a miter saw, chop saw, radial arm saw, table saw, or the like with reference to a blade of the saw.

BACKGROUND OF THE INVENTION

Industrial machine tools such as numerically controlled milling machines and the like have been provided with adjustable stages, chucks, and other devices for holding a work piece with respect to a working tool such as a drill press, milling head, band saw, or the like. Typically, such devices hold the work piece in place while the working tool itself moves with respect to the work piece. More sophisticated machinery also permits the automatic feeding of material stock (e.g., bar stock) to the working tool for placement with respect thereto. Such systems employ feedback mechanisms to assure that the working material is actually in place, and is properly aligned with the working tool. Homeowners utilizing woodworking tools such as table saws, miter saws (compound, sliding) radial arm saws, and the like cannot be provided with such automated mechanisms in a cost effective manner. Thus, the home hobbyist, cabinet maker or the like must necessarily measure and mark the work piece to be cut at a desired dimension and then proceed by manually placing the work piece with respect to the cutting blade or the like. As a consequence, woodworkers have adopted the motto, "measure twice, cut once." Thus, it is acknowledged that measuring a proper cutting dimension on a work piece is a source of error for a home craftsman utilizing a cutting tool which does not have automatic means for positioning the work piece with respect to the cutting tool or vice versa. In recognition of this disadvantage, power tool manufacturers have for some time provided various saws (e.g., table saws) with manually positionable fences which can be set at a calibrated distance from a cutting tool, such as a saw blade. In this manner, once the fence has been set by the user, repeated cuts can be made at this dimension without the necessity of having to mark the work piece, and thus measure the cut in advance. Although devices such as rip fences, miter guides, and the like dramatically reduce cross-cut errors, the user must manually and carefully reset the fence for every different dimension cut. Unless the user has carefully worked out the various cut dimensions in advance, such as to organize the various work pieces (particularly with respect to standard dimension lumber) in a logical sequence, the manually adjustable fence may be repositioned numerous times with respect to the completion of a single project (e.g., a book case). This disadvantage is exacerbated when the various cut dimensions may not be known in advance during a planning stage. By way of example, a carpenter installing baseboard or crown molding in a home will arrive at the jobsite and by necessity take numerous wall and ceiling measurements, transfer these measurements to a work piece by marking and then make all the various cuts. If a standard conventional manual repetitive fence is used, a great deal of organizational forethought is necessary to minimize adjustment of the fence throughout completion of a typical job.

Therefore, a need exists for a repetitive cross-cut fence which minimizes the number of adjustments which are necessary for operation of the fence for a typical job.

A further need exists for a repetitive cross-cut fence which is easily adjustable for a variety of various cross-cut lengths while minimizing user error.

Yet another need exists for repetitive cross-cut fence which is easily readable and settable by a user.

SUMMARY OF THE INVENTION

It is therefore an object of the present invention to provide for a repetitive cross-cut fence which minimizes the number of adjustments which are necessary for operation of the fence for a typical job.

It is a further object of the present invention to provide for a repetitive cross-cut fence which is easily adjustable for a variety of various cross-cut lengths while minimizing user error.

It is yet another object of the present invention to provide for a repetitive cross-cut fence which is easily readable and settable by a user.

The invention achieves the above objects, and other objects and advantages which will become apparent from the description which follows, by providing a repetitive fence for attachment to a cross-cut saw with reference to a saw blade. The invention includes an extensible member having a work piece stop member adjacent to a distal end thereof for receipt of an end of a material to be cross-cut, such as a length of standard dimension lumber. A drive mechanism is operatively connected to the extensible member for moving the stop member to a pre-selected distance. A mensuration device is operatively connected to the stop member for determining a relative position between the saw blade and the stop member. A visual display is provided for displaying the relative position between the stop member and the saw blade so that the user is provided with visual feedback as to the position of the repetitive fence.

In preferred embodiments of the invention, the drive mechanism includes a coiled, drive tape having a main portion wound round a hub, an end portion connected to the extensible member, and a plurality of apertures positioned a regular intervals thereon for engagement with teeth on a drive sprocket. The drive sprocket has a first pulley portion thereon, and the drive mechanism further includes a drive gear having a second pulley portion thereon. The first and second pulley portions are operatively interconnected by a drive belt such that rotation of a drive gear causes the drive tape to extend and retract the stop member. The drive belt preferably has a tension selected such that the drive belt can slip on the pulleys to permit the stop member to be manually extended and retracted when the drive gear is stationary. In this way, the visual display at all times advises the user of the relative position of the stop member with respect to the saw blade regardless of the manner in which the extensible member is extended or retracted.

In an alternate embodiment of the invention, the drive mechanism includes a prime mover connected to the drive gear preferably through a worm gear and the extensible member has a plurality of relatively slidable arms. The arms may telescope or nest inside one another. The prime mover may be an electric motor, such as an electronically controlled stepper motor, or a manual crank. The mensuration devise is preferably a position sensor which measures an amount of drive tape played either in or out to determine the relative position of the stop member with respect to the blade. An optical encoder may be used for this purpose. The optical encoder may read a bar code on the tape, or the apertures within the tape, or both. The repetitive fence is preferably provided with an electronic keyboard for measurement input, an electronic digital display for displaying the relative position of the stop member with respect to the saw blade, and an electronic logic device, such as a microprocessor. In a method of the present invention, the logic device employs a computer program which permits the user to input the dimensions to be cut, and the number of cuts to be made in a standard dimensional lumber. The logic unit then orders the cuts in an optimal sequence so as to minimize the number of cuts to be made, adjustments of the extensible member, and the amount of waste material generated by the cuts.

DETAILED DESCRIPTION OF THE PREFERRED EMBODIMENTS

Figure 1:
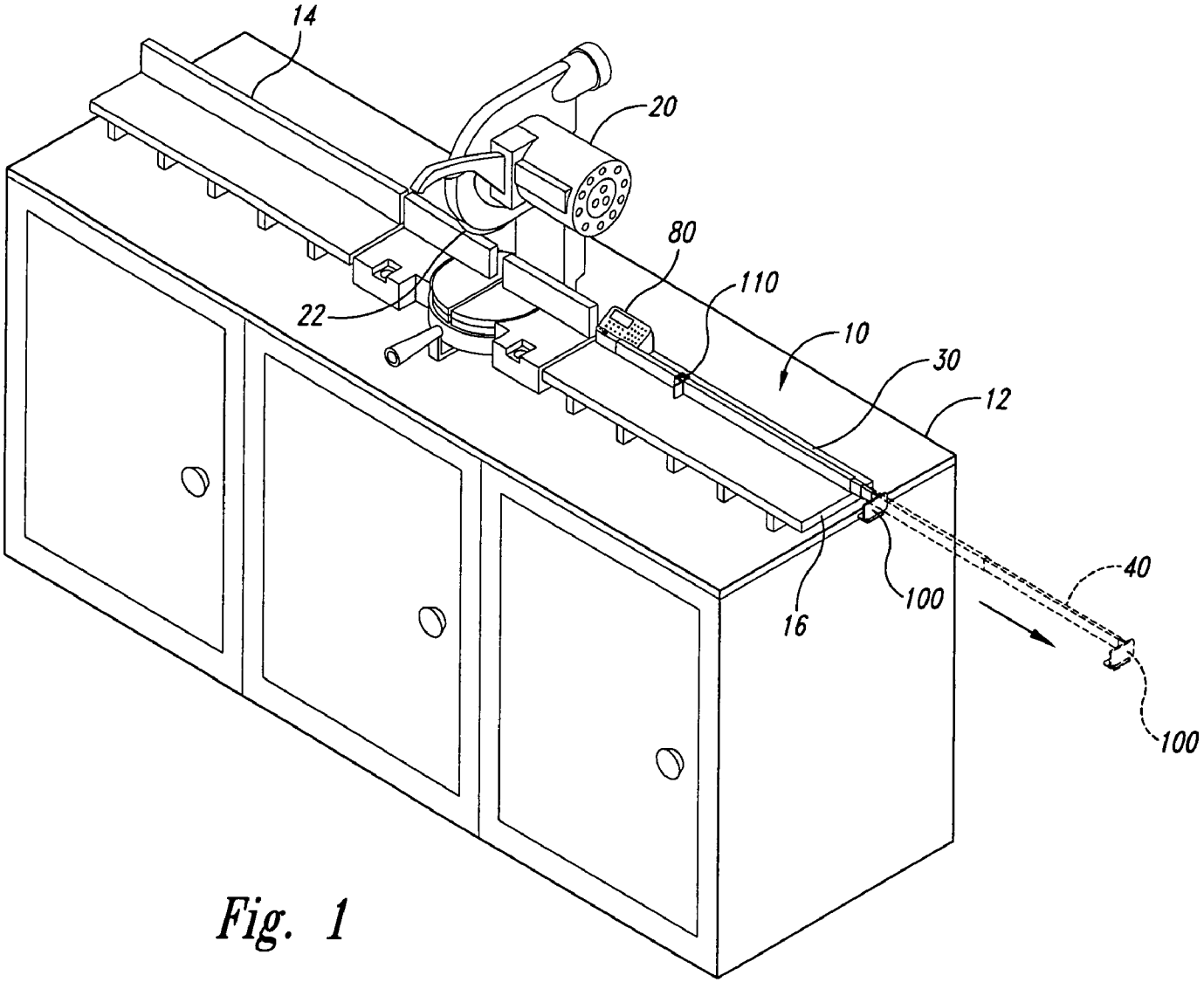
FIG. 1 is an isometric, environmental view showing the repetitive fence for cross-cutting materials of the present invention in use with a conventional miter chop saw and work bench.
Figure 2:
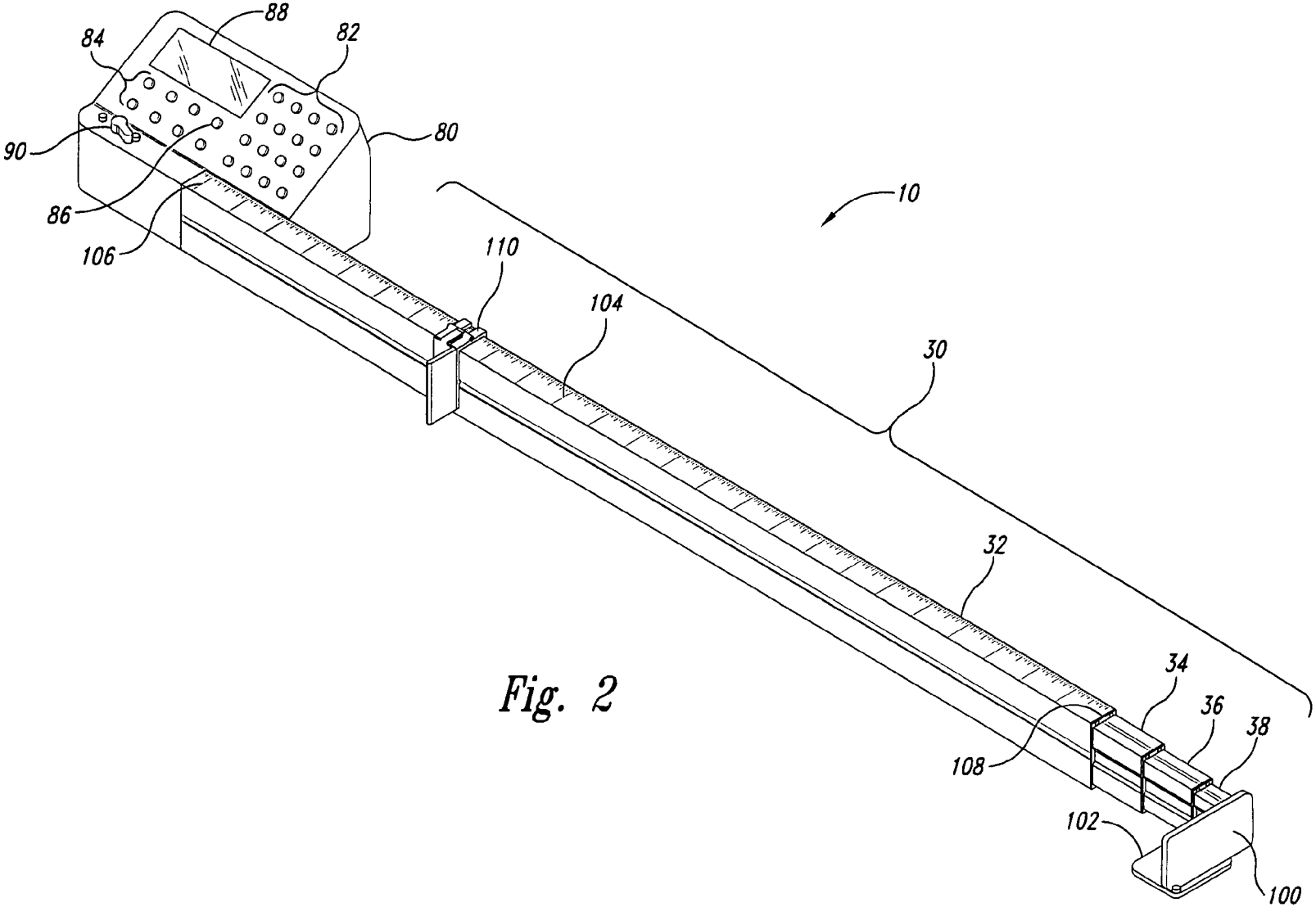
FIG. 2 is an isometric, perspective view of the repetitive fence shown in FIG. 1.

A first embodiment of a repetitive fence for cross-cutting materials, such as lumber in accordance with the principals of the invention is generally indicated at reference 10 in FIGS. 1 and 2 wherein numbered elements in the figures correspond to like numbered elements herein. FIG. 1 shows the invention in use in a typical home workshop environment in connection with a work bench 12 having an in-feed table 14, and a spaced apart out-feed table 16. A circular chop saw 20 having a motor driven rotatable blade 22 is positioned between the tables 14, 16. The saw 20 is illustrated by way of example only so as to represent a cross-cutting saw which may be of a variety of types including circular table saws, radial arm saws, miter saws (compound, sliding) chop saws (rotary, band, reciprocating) or any other type of cutting or milling device which may work against the long dimension of a work piece, such as standard dimension lumber. The repetitive fence 10 permits a user (not shown) to repeatedly position a work piece (such as a length of standard dimension lumber) within the saw at a pre-determined length dimension in a repeatable and accurate manner, without having to measure and mark the work piece. The repetitive fence 10 can also be provided with means for automatically positioning the work piece at a variety of different dimensions with respect to the saw blade 22 such as to optimize, for example, the use of standard dimension lumber, as will be described in further detail herein below. The repetitive fence 10 may be affixed to the out-feed table 16 semi-permanently, such as by screws passing through flanges 24 (see FIG. 6), C-clamps, or other means which will be apparent to those of ordinary skill in the woodworking art. Thus, the repetitive fence 10 can be moved from one work station, work bench, etc. to another or to a remote job site for use with portable saws and the like.

Figure 3:
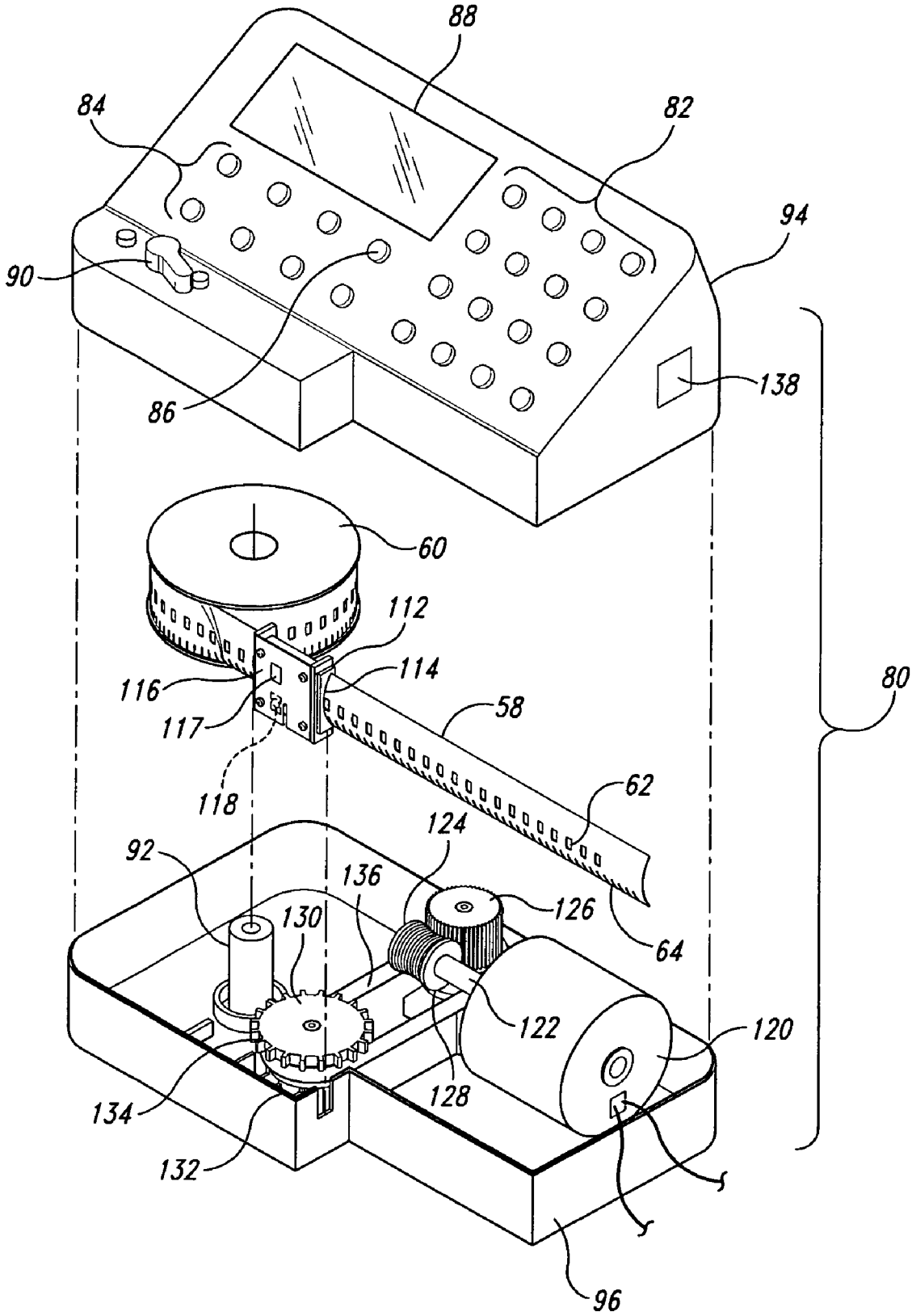
FIG. 3 is an isometric, perspective exploded view of a housing for the repetitive fence.
Figure 4:
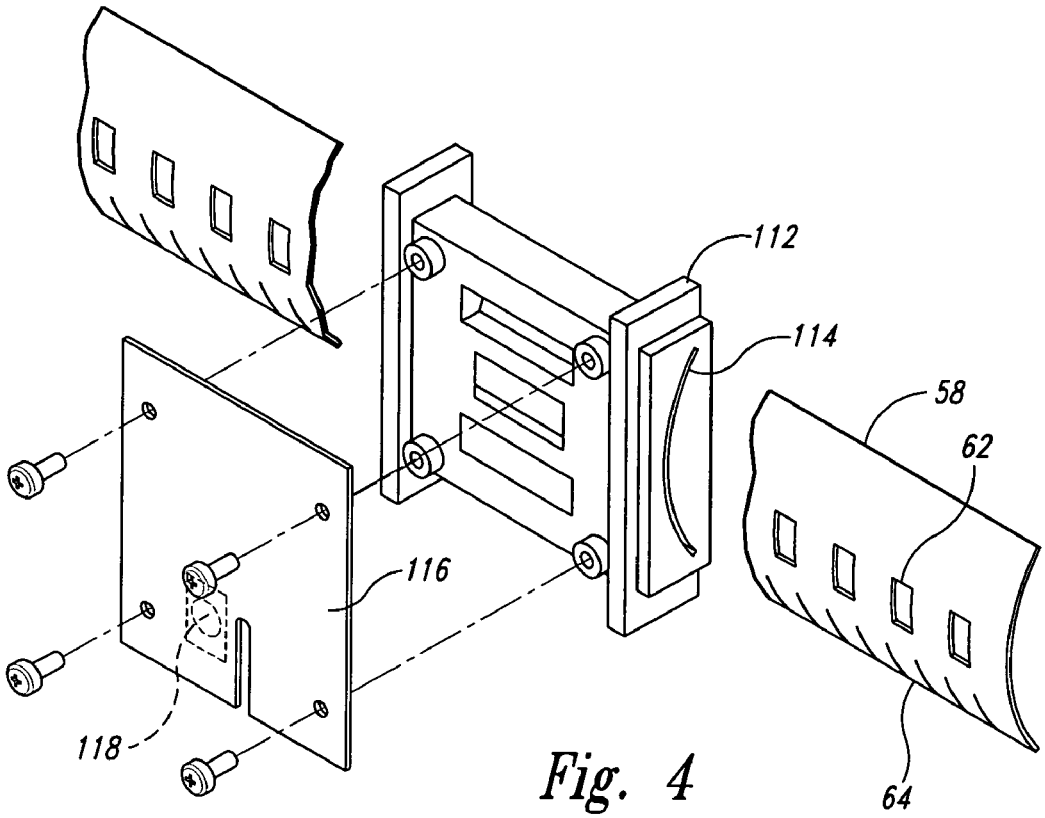
FIG. 4 is an enlarged, partial isometric view of a mensuration device for use with the invention.
Figure 5:
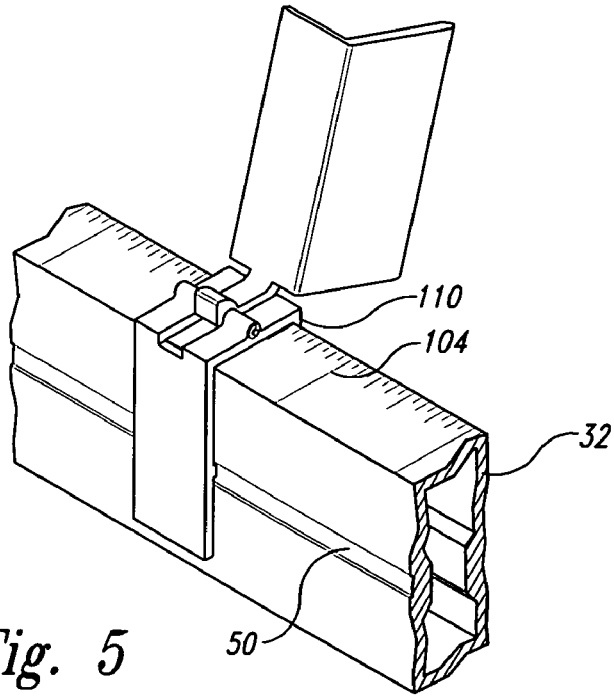
FIG. 5 is an environmental, perspective view of a first manual stop in use with a fixed arm of the preferred embodiment.
Figure 6:
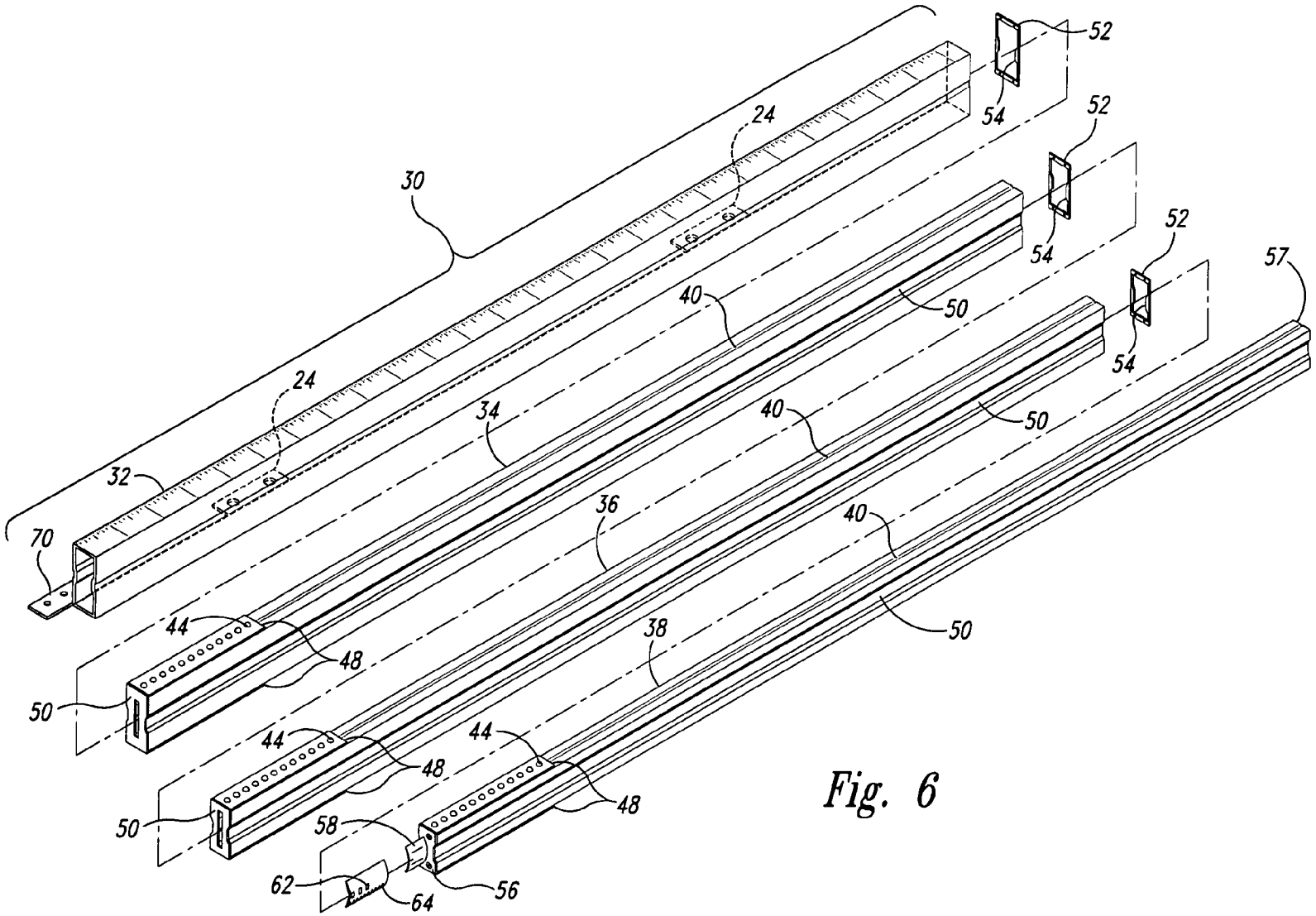
FIG. 6 is an exploded isometric view of three telescoping arms which nest within the fixed arm shown in FIG. 5.

As best seen in FIGS. 2 and 6, repetitive fence 10 has a telescopic arm assembly 30 consisting of a fixed first arm 32, a second intermediate movable arm 34, a third intermediate movable arm 36, and a fourth, movable end arm 38. The second through fourth arms preferably nest inside one another sequentially, and also within the first fixed arm 32. The second through fourth arms each have upper bearing grooves 40 and corresponding lower bearing grooves (not shown) for receipt of linear bearings 44 (such as conventional ball bearings) retained by bearing retainers 48. The second through fourth arms 32, 36, and 38 are also provided with longitudinal guide grooves 50 on each lateral side. In addition, end caps 52 defining an aperture sized for receipt of each subsequent, corresponding arm are provided on the distal ends of the first, second, and third arm. The end caps also have protrusions 54 corresponding to the respective grooves 50 to further guide the arms. Thus, the grooves 50 in cooperation with the protrusions 54 on the end caps 52, and assisted by the support provided by the bearings 44 permit the second, third, and fourth telescopic arms 34, 36, and 38 to smoothly and accurately reciprocate in a telescopic manner with respect to the first fixed arm 32. The fourth movable end arm 38 has a fore cap 56 connected to a proximal end, such as by screws. The fore cap 56 is provided for the purpose of anchoring a coilable drive tape 58 thereto. The fourth end arm also defines a distal end 57. The coilable drive tape may be manufactured from spring steel, in a fashion similar to a sprung, coiled metal tape used in a conventional tape measure. As best seen in FIG. 3, the coiled tape has another end (not shown) connected to a hub of, and wound about a drive reel 60. The drive tape is preferably provided with a plurality of regularly spaced drive apertures 62 for moving the tape as will be described further below, and the tape is also provided with a position indicating barcode 64.

The first arm 32 has a flange 70 defining screw apertures 72 for mounting the telescopic arm assembly 30 to a base unit 80. The base unit includes an electronic, numeric keypad section 82, an electronic command key pad section 84 including an "enter" key 86, and a digital alpha-numeric read-out display 88 of the liquid crystal, light emitting diode, or the like type. The base unit 80 may also incorporate a cam actuated locking lever 90 to manually fix the position of the drive tape 58 and thus the distal end 57 of the fourth movable arm 38 with respect to the base unit 80.

As will be apparent to those of ordinary skill in the art, translating the fourth movable arm 38 longitudinally with respect to the first fixed arm 32 and base unit 80 plays the drive tape 58 onto and off of the drive reel 60, and vice versa. The base unit 80 is therefore provided with a vertically oriented drive reel axle 92 so as to prevent translation of the drive reel 60 with respect to the base unit 80 while permitting the drive-reel 60 to rotate thereabout.

The base unit 80 may be provided with an upper housing 94, and a lower housing 96 manufactured from thermo-plastic materials, or metal. The distal free-end 57 of the fourth movable arm 38 is provided with a stop member 100 attached thereto, such as by screws (not shown). The stop member 100 also has pivotally connected thereto, a base plate 102 which may be used to support the free end of material to be cut, such as a wooden board.

The first fixed arm 32 is preferably provided with conventional scale markings 104 such as in inches (or centimeters) indicating the distance thereon from a hypothetical saw blade, such as saw blade 22. Thus, the repetitive fence 10 is mounted to the out-feed table 16, or the like, such that an initial index mark 106 is located a known distance from the hypothetical saw blade, such as twelve inches. Thus, when initially setting up the repetitive fence 10 with respect to a saw blade, such as the saw blade 22, the user must measure the "zero distance" twelve inches from the saw blade, position the index mark 106 thereat and either clamp down or screw down the repetitive fence 10 to the in-feed table at that position. The repetitive fence should also be positioned in a perpendicular relationship with the cut of the saw blade 22 for right angle cross-cuts.

As best seen in FIG. 2, the first fixed arm 32 has a length of approximately forty eight inches. Thus, a distal scale mark 108 is positioned approximately sixty inches from the saw blade 22 after the repetitive fence 10 has been "zeroed" with respect to the saw blade. For cuts less than sixty inches in length, the first arm 32 is provided with a slidable, cam action stop member 110. The slidable stop member 110 may be positioned anywhere along the first arm 32 between the index mark 106 and distal scale mark 108 to provide a stop for a work piece wherein the cut to be made is less than sixty inches. For all cuts over sixty inches, a movable stop member 100 is displaced as set forth above.

It will be understood by those of ordinary skill in the art that by moving the distal free-end 57 of the fourth movable end arm 38 inwardly or outwardly, with respect to the base unit 80 and first fixed arm 32, both the barcode 64 and drive aperture 62 will move past a fixed reference point associated with either the base unit 80 or the first fixed arm 32. The repetitive fence 10 is therefore provided with an electronic mensuration device 112 defining crescent-shaped slots 114 for passage there through of the drive tape 58.

The electronic mensuration device 112 is electronically and cooperatively connected with the digital read-out 88 such that the position of the free-end 57 and stop member 110 with respect to the base unit 80 (and therefore saw blade 22) may be displayed. The mensuration device 112 includes a printed circuit board 116 incorporating an electronic logic unit 117 such as a microprocessor, programmable logic array, microcontroller to the like for detecting and interpreting electronic signals from photo detectors 118. The photo detectors read the passage of the drive apertures 62, barcode 64, or both to determine the absolute position of the free-end 57 with respect to the base unit 80. The electronic mensuration device 112, logic unit 117, and photo detectors 118 are all electronically interconnected on the printed circuit board 116 so as to provide a reading on the read-out display 88 indicative of the distance of the end member 100 with respect to the saw blade 22. Depending on the particular methodology employed by the electronic mensuration device 112, the reading may be of an extremely high accuracy, far greater than that achievable with a tape measure and pencil marking by a conventional woodworker. Conversely, it will be apparent that by driving the metal tape drive 58, either inwardly or outwardly with respect to the base unit 80, the stop member 100 can be positioned at any desired location as indicated by the read-out display 88.

Those of ordinary skill in the art will be familiar with a wide variety of mathematical and electronic techniques for determining the absolute position of a series of regularly spaced apertures, or a periodic barcode with respect to an optical measuring device. Mitutoyo Corporation, Japan manufactures a wide variety of devices suitable for this purpose. One such implementation using Mitutoyo sensors is described in U.S. Pat. No. 5,225,830 issued on Jul. 6, 1993 to Andermo et al. The disclosure which is herein incorporated by reference. Although the preferred system implemented by the electronic mensuration device 112 is of the absolute positioning type, for lower cost applications, a relative positioning sensing system may also be suitable. The electronic command keypad section 84 preferably has dedicated buttons assigned thereto which when struck cause the read-out 88 to provide desired units such as one-eighth inch, quarter inch, or metric units.

In order to facilitate automatic operation of the repetitive fence 10, the base unit 80 is provided with an electronic motor 120. The motor is preferably of the D.C. stepper type. The motor has a shaft 122 having a worm gear 124 journaled to a free-end thereof. The worm gear 124 engages a drive gear 126 journaled for rotation with respect to a spindle portion of the lower housing 96. The drive gear has a pulley portion 128 concentrically mounted thereon. The lower housing also has a drive sprocket 130 journaled for rotation on a separate spindle portion thereof also having a concentric pulley portion 132. The drive sprocket has a plurality of radially directed drive teeth 134 having a tooth pitch equal to the periodicity of the drive apertures 62 on the metal drive tape 58. The drive teeth 134 are engaged with the drive apertures 62. The pulley portions 132, 128 of the drive sprocket 130 and drive gear 126 are engaged with a resilient drive belt 136, manufactured from rubber, a synthetic polymer or any other suitable material. The drive belt 136 translates rotary motion of the shaft 122 to linear motion of the drive tape 58. The electronic numeric key pad section 82 of the base unit 80 is electronically interconnected with the logic unit 117 by way of the printed circuit board such that a user can input a desired dimension on the key pad 82 and such dimension will appear on the display 88. By pushing the "enter" key 86, the logic unit 117 will command the motor 120 to drive the tape 58 until the stop member 100 arrives at the desired location. Such arrival may be confirmed by the user observing the display 88. The user may also input a desired dimension to the repetitive fence 10 by other means which advantageously employ the repetitive fence's ability to electronically move the stop end 100 to a desired dimension. Those of ordinary skill in the art are well aware that a variety of electronic tape measure-type devices have been reduced to practice in the prior art. U.S. Pat. No. 5,691,923 to Alder et al., issued Nov. 25, 1997 and U.S. Pat. No. 5,983,514issued to Lindsey on Nov. 16, 1999 each disclose electronic tape measures having means for outputting an electronic representation of the distance measured. In this preferred embodiment, the base unit 80 of the repetitive fence 10 is preferably provided with an electronic measurement input 138 in the form of an infrared receiver, I.E.E.E. RS 232 port, or the like for interfacing with an electronic tape measure or the like. Said prior art, electronic tape measure may download an entire sequence of measurements to the electronic logic unit 117 for actuation into a linear positioning of the stop member 100. The user may increment the drive tape 58 to each subsequent, received measurement merely by depressing the "enter"key 86. Thusly, an entire sequence of measurements (e.g., a series of measurements of room wall dimensions for crown or floor molding) may be electronically downloaded to the repetitive fence 10 by an electronic type measure without ever having to physically transfer those measurements by way of retractable tape or the like to the material to be cut, and then marking the material. Numerous errors, wasted time, and wasted material are thus avoided by the invention and its concomitant method of use.

Figure 8:
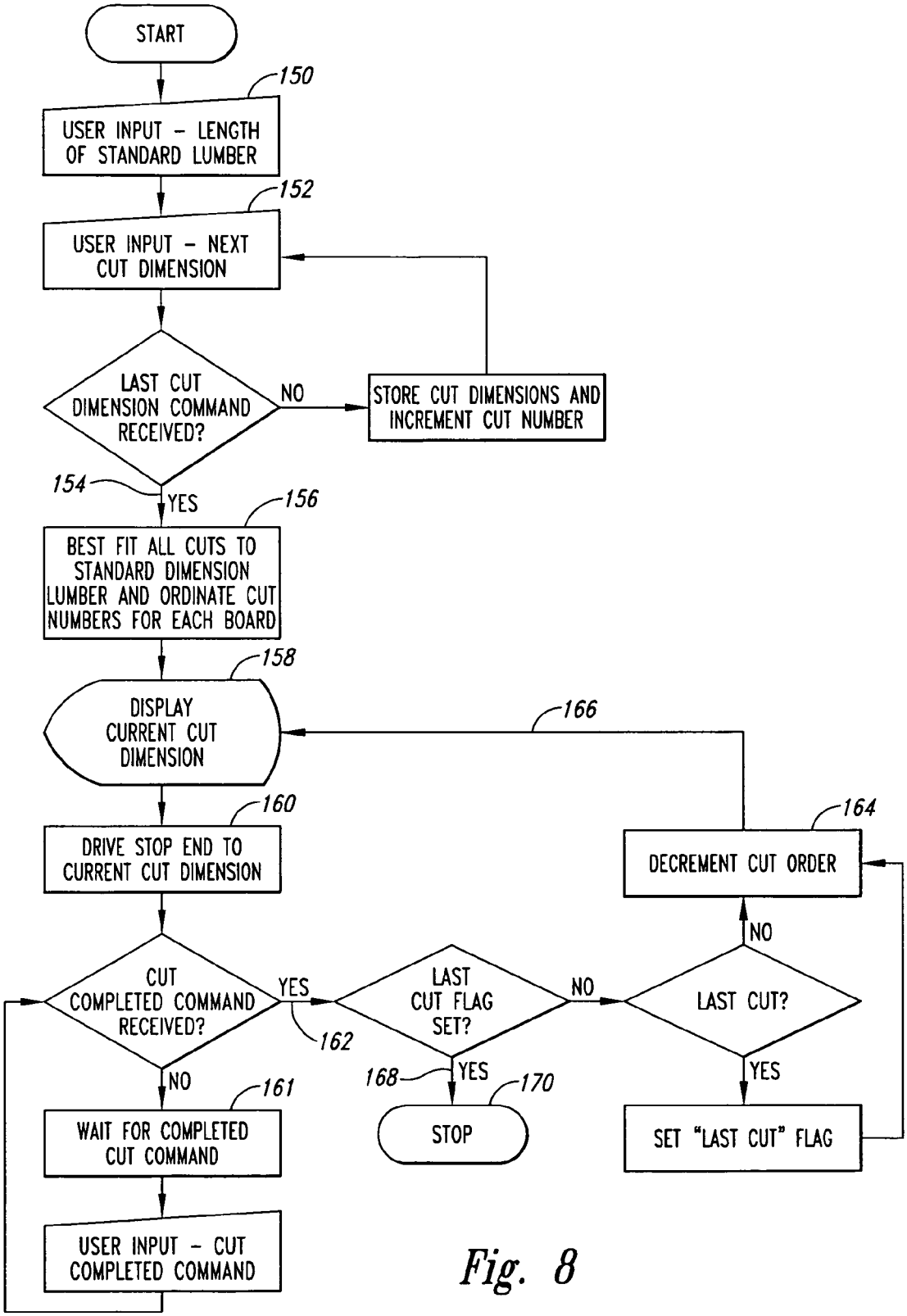
FIG. 8 is a logic diagram for a method of the invention implementing a technique for minimizing waste material in a typical job.

Further advantages of the invention will be apparent to those of ordinary skill in the relevant art upon reviewing the logical flow diagram shown in FIG. 8. Carpenters, cabinet makers, and other woodworkers are well aware that before beginning any significant project, a bill of materials, and a list of cut dimensions are usually prepared (and/or provided on plans previously purchased). By advantageously providing the electronic mensuration device 112 with a logic unit 117 such as a microprocessor or other device capable of logical reasoning through a pre-loaded program, the microprocessor, or the like can determine the proper ordering of cuts to minimize the number of movements of the stop member 100 necessary to perform all the cuts, and also so as to minimize the amount of waste material remaining after all the cuts have been made, such as in standard dimension lumber. By way of example, and with reference to FIG. 8, it can be contemplated that a user may wish to construct a bookcase from a number of boards of standard dimension lumber. The user would start 150 by inputting, the length of the standard dimension lumber to be used (e.g., six foot) on the numeric key pad 82 and then pressing the enter key 86. The user would next input each of the cut dimensions 152 until the last cut dimension 154 is input, as indicated by depressing one of the electronic command keys 84 which have been dedicated to that task. The microprocessor, or other logic unit 117 then performs a best fit analysis 156 so as to ordinate all of the cuts with respect to one another to minimize the number of movements of the stop member 100 necessary to make those cuts, and to minimize the amount of waste material after all of the cuts have been completed. The display 88 then displays 158 the first cut dimension. The motor 120 then drives 160 the drive tape 58 to simultaneously position the stop end 100 at the first cut dimension. Those of ordinary skill in the numerical methods art are well aware of a variety of routines for best fitting and optimizing dimensional measurements against a pre-established set, such as a set of numbers related to pre-cut dimensional lumber.

After the user has completed all of the indicated cuts of that dimension, the user inputs a cut completed command 162 by way of one of the dedicated keys on the key pad 84. If the last ordered cut has not been made, the cut order is decremented 164 and the new, current cut dimension is displayed on the display 88. This process 166 is repeated until the last completed cut command 161 has been received. The logic unit or microprocessor 117 then sets a "last cut flag" 168 and stops the process 170.

In addition to the electronic advantages described above with respect to automatically inputting a series of cuts to be made, the repetitive fence 10 also permits manual override of any pre-selected dimensions. As stated above, the resilient drive belt 136 has a tension selected such that the drive sprocket 130 may slip with respect to the drive gear 126 upon manual displacement of the movable stop member 100 from any rest position. Advantageously, the display 88 will record any such displacement as a new position reading. Thus, the user may "interrupt" a programmed sequence of cuts with a manual cut to a desired distance merely by translating the movable stop member 100 to any desired position as indicated by the display 88. The user may then move stop member 100 to the previous position and commence with the automated sequence of cuts.

Figure 7:
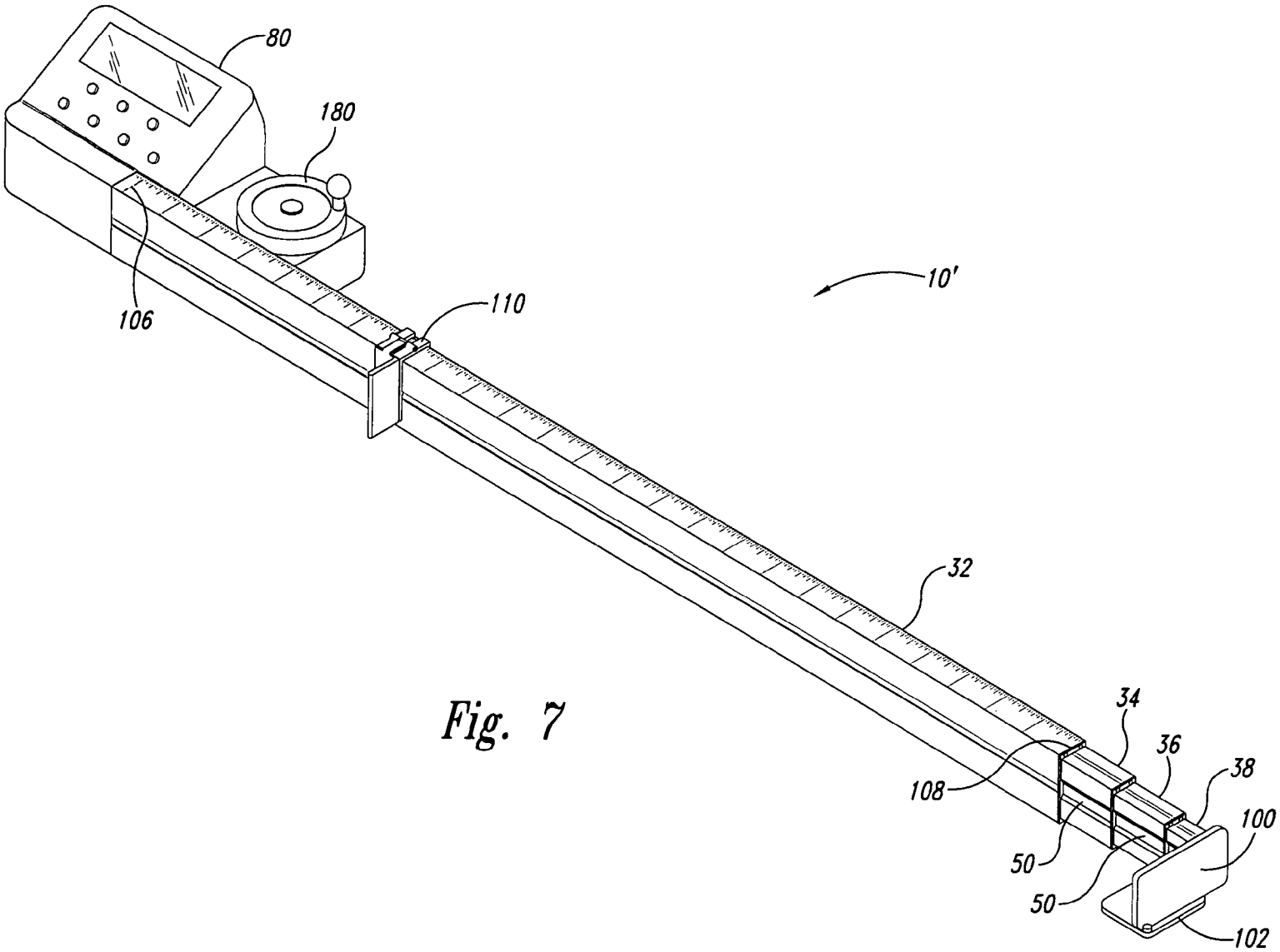
FIG. 7 is an isometric perspective view of an alternate, manual embodiment of the invention.

An alternate embodiment of the invention 101 shown in FIG. 7 employs all of the structure and advantages of the embodiment shown in FIGS. 1-6 except that the electronic motor 120 is replaced by a hand crank 180 and right angle spur gear (not shown).

Other embodiments and variations of the invention will be apparent to those of ordinary skill in the relevant art upon reviewing this disclosure. Thus, the invention is not to be limited to the above description, but is to be determined in scope by the claims which follow.

I claim:

1. A repetitive fence for attachment to a cross-cut saw with reference to a saw blade, comprising:

an extensible member having a work piece stop member attached thereto, the stop member being adapted to restrain dimensional lumber against inadvertent movement away from the saw blade;

a bidirectional, positive drive mechanism having a tape drive sprocket for moving the stop member to a pre-selected distance;

a coiled, drive tape having a main portion wound around a hub, an end portion connected to the extensible member, and a plurality of apertures positioned at regular intervals thereon for engagement with teeth on the drive sprocket;

a mensuration device, operatively connected to the stop member for determining a relative position between the blade and the stop member; and, display means for visually displaying the relative position.

2. The repetitive fence of claim 1, wherein the drive sprocket has a first pulley portion thereon and the drive mechanism includes a drive gear having a second pulley portion thereon, wherein the drive mechanism further includes a drive belt interconnecting the pulley portions such that rotation of the drive gear causes the drive tape to extend and retract the stop member.

3. The repetitive fence of claim 2, wherein the drive belt has a tension selected such that the drive belt can slip on the pulley portions to permit the stop member to be manually extended and retracted when the drive gear is stationary.

4. The repetitive fence of claim 2, wherein the drive mechanism includes a prime mover rotatably connected to the drive gear though a worm gear, and the extensible member has a plurality of relatively slidable arms.

5. The repetitive fence of claim 4, wherein the prime mover is an electric motor.

6. The repetitive fence of claim 4, wherein the prime mover is a manual crank.

7. The repetitive fence of claim 2, wherein the mensuration device is a position sensor which measures an amount of drive tape played in and out to determine the relative position of the stop member with respect to the blade.

8. The repetitive fence of claim 7, wherein the position sensor is an optical encoder which reads the apertures in the tape.

9. The repetitive fence of claim 7, wherein the display means is an electronic digital readout, and the drive means includes a position sensitive electric motor rotatably connected to the drive gear and the repetitive fence further includes a digital keypad and an electronic control system electronically connected to the readout, the keypad and the motor so that a user can input a desired cut length into the repetitive fence through the key pad, the motor can advance the stop to the desired cut length and the readout can verify that the stop is at the desired cut length.

10. The repetitive fence of claim 9 including logic means, operatively coupled with the electronic control system for prioritizing and optimizing an order of plurality of cuts to be made.

11. A repetitive fence for attachment to a cross-cut saw with reference to a saw blade, comprising:

a plurality of telescopic arms, one of the telescoping arms having a work piece stop member proximal to a distal end thereof, the stop member being adapted to restrain dimensional lumber against inadvertent movement away from the saw blade;

drive means for moving the stop member to a pre-selected distance, wherein the drive means includes a drive tape having a main portion wound around a hub, a distal end connected to the one of the telescoping arms, and a plurality of apertures positioned at regular intervals thereon for engagement with teeth on a drive sprocket;

mensuration means, operatively connected to the stop member for measuring a relative position between the blade and the stop member; and, display means for visually displaying the relative position.

12. The repetitive fence of claim 11, wherein the drive means further includes a transmission having a drive gear and a drive sprocket each having a pulley portion thereon and a drive belt interconnecting the pulley portions.

13. The repetitive fence of claim 12, wherein the drive belt has a tension selected such that the drive belt can slide on the pulley portions to permit the stop member to be manually extended and retracted independently of the drive gear.

14. The repetitive fence of claim 12, wherein the drive means includes a prime mover rotatably connected to the drive gear though a worm gear.

15. The repetitive fence of claim 14, wherein the prime mover is an electric motor.

16. The repetitive fence of claim 14, wherein the prime mover is a manual crank.

17. The repetitive fence of claim 12, wherein the mensuration means includes a position sensor which measures an amount of tape played in and out to determine the relative position of the stop member with respect to the blade.

18. The repetitive fence of claim 17, wherein the position sensor is an optical encoder which reads the apertures in the tape.

19. The repetitive fence of claim 17, wherein the display means is an electronic digital readout, and the drive means includes a position sensitive electric motor rotatably connected to the drive gear and the repetitive fence further includes a digital keypad and an electronic control system electronically connected to the readout, the keypad and the motor so that a user can input a desired cut length into the repetitive fence through the key pad, the motor can advance the stop to the desired cut length and the readout can verify that the stop is at the desired cut length.

20. The repetitive fence of claim 19 including logic means, operatively coupled with the electronic control system for prioritizing and optimizing an order of plurality of cuts to be made.

* * * * *